US005925228A

United States Patent [19]

Panitz et al.

[11] Patent Number: 5,925,228

[45] **Date of Patent: *Jul. 20, 1999**

[54] ELECTROPHORETICALLY ACTIVE SOL-GEL PROCESSES TO BACKFILL, SEAL, AND/OR DENSIFY POROUS, FLAWED, AND/OR CRACKED COATINGS ON ELECTRICALLY CONDUCTIVE MATERIAL

[75] Inventors: Janda K. Panitz, Sandia Park; Scott T. Reed, Albuquerque; Carol S. Ashley, Albuquerque; Richard A. Neiser, Albuquerque; William C. Moffatt, Albuquerque, all of N.M.

[73] Assignee: Sandia Corporation, Albuquerque, N.M.

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,069

[22] Filed: Jan. 9, 1997

[51] Int. Cl.[6] ..... C25D 13/02

[52] U.S. Cl. ..... 204/484; 204/486; 204/491; 204/490

[58] Field of Search ..... 204/490, 491, 204/484, 486

[56] References Cited

U.S. PATENT DOCUMENTS

| | | | |
|---|---|---|---|
| 4,357,222 | 11/1982 | Lucek | 204/472 |
| 4,971,633 | 11/1990 | Beavis et al. | 136/246 |
| 5,223,104 | 6/1993 | Grassi et al. | 204/484 |
| 5,468,358 | 11/1995 | Ohkawa et al. | 204/491 |
| 5,609,741 | 3/1997 | Illston et al. | 204/491 |

FOREIGN PATENT DOCUMENTS 08134469 5/1996 Japan .

OTHER PUBLICATIONS

Yining Zhang, C. Jeffrey Brinker and Richard M. Cooks, Electrophoretic Desposition of Sol–Gel–Derived Ceramic Coatings, Mat. Res. Soc. Symp. Proc. vol. 271, 1992.

C. J. Brinker, K. D. Keefer, D. W. Schaefer and C. S. Ashley, Sol–Gel–Transition in Simple Silicates, Journal of Non–Crystalline Solids 48 (1982) 47–64 North–Holland Publishing Company.

C. J. Brinker, T. L. Ward, R. Sehgal, N. K. Raman, S. L. Hietala, D. M. Smith, D. W. Hau and T. J. Headley, "Ultramicroporous" Silica–Based Supported Inorganic Membranes, Journal of Membrane Science, 77 (1993) 165–179, Elsevier Science Publishers B.V., Amsterdam.

Susan L. Hietala, Douglas M. Smith, Johnny L. Golden and C. Jeffrey Brinker, Anomalously Low Furface Area and Density in the Silica–Alumina Gel System, Communications of the American Ceramic Society, Dec. 1989, vol. 72. No. 12, pp. 2354–2358.

W. L. Warren, P. M. Lenahan, C. J. Brinker, C. S. Ashley, S. T. Reed and G. R. Shaffer, Sol–Gel Silicate Thin–Film Electronic Properties, J. Appl. Phys. 69 (8), Apr. 15, 1991, pp. 4404–4408.

K. Moriya, H. Tomino, Y. Kandaka, T. Hara, and A. Ohmori, Sealing of Plasma–Sprayed Ceramic Coatings by Sol–Gel Process, Proceedings of the 7th National Thermal Spray Conference, Jun. 20–24, 1994, Boston, Massachusetts, pp. 549–553.

*Primary Examiner*—Kishor Mayekar
*Attorney, Agent, or Firm*—Elmer A. Klavetter

[57] ABSTRACT

Electrophoretically active sol-gel processes to fill, seal, and/or density porous, flawed, and/or cracked coatings on electrically conductive substrates. Such coatings may be dielectrics, ceramics, or semiconductors and, by the present invention, may have deposited onto and into them sol-gel ceramic precursor compounds which are subsequently converted to sol-gel ceramics to yield composite materials with various tailored properties.

27 Claims, 4 Drawing Sheets

ELECTROPHORETICALLY ACTIVE SOL-GEL PROCESSES TO BACKFILL, SEAL, AND/OR DENSIFY POROUS, FLAWED, AND/OR CRACKED COATINGS ON ELECTRICALLY CONDUCTIVE MATERIAL

This invention was made with Government support under Contract No. DE-AC0494AL85000 awarded by the United States Department of Energy. The Government has certain rights in the invention.

BACKGROUND OF THE INVENTION

A variety of techniques such as physical vapor deposition (PVD), chemical vapor deposition (CVD), pyrolysis and similar chemical conversion processes, anodizing, electrostatically charged powder deposition, and thermal spraying (including flame spraying, high-velocity oxy/fuel spraying, and plasma spraying) are commonly used to deposit dielectric, ceramic, and semiconductor coatings. Applications for these coatings are in corrosion protection, thermal management, optics, and electronics.

For example, aluminum and its alloys are commonly anodized to form aluminum oxide coatings that slow salt water spray-induced corrosion of machinery and architectural elements. Anodized aluminum alloy plates and metal plates with thermal-spray electrical insulators are used as supports to hold solar cells wired in series.

Many photovoltaic mounting structure designs specify that the electrically insulating coating must have good thermal conductivity so that the cells can be cooled efficiently. It is a common practice to anodize satellite hardware to control optical emissivity. The semiconductor fabrication industry uses anodized aluminum fixtures in plasma-assisted etch and CVD tools to protect these parts against corrosive working gases, and shape plasmas or tailor plasma potentials. Anodic coatings and thermal-spray coatings are used as dielectrics on electrostatic chucks to hold electrically conductive parts during fabrication or processing.

The dielectric, ceramic, optical, and semiconductor coatings that are applied by PVD, CVD, chemical-conversion processes, anodizing, and thermal spraying may be porous, cracked, or flawed, permitting corrosive liquids, gases, and vapors to attack the underlying substrates. Pores, cracks, and flaws may give rise to anomalies in, or totally dominate, the electrical properties of these coatings, or increase electrical leakage and reduce electrical-breakdown strength. Pores, cracks, and flaws reduce thermal conductivity, and can harbor gases, liquids, and vapors that add to the gas load if these coatings are used in a vacuum system.

It is common practice to seal pores in anodic aluminum oxide coatings by immersing anodized parts in water at or near the boiling point, or by processing the parts in an autoclave. The anodic aluminum oxide is thus hydrolyzed and converted to boehmite which seals the pores. The amount of boehmite formed by hydrolyzing anodic aluminum oxide is sufficient to fill the pores in a coating to some depth, but it does not adequately seal relatively large cracks and defects. Boehmite is mechanically and chemically fragile compared with many sol-gel derived ceramics, and has an index of refraction and optical absorption bands which may not be desirable in optimizing the optical properties of a coating.

High-velocity oxy/fuel, plasma-spray processes, and vacuum plasma-spray processes can be used to deposit relatively dense coatings. (For certain applications, it is desirable to have some amount of porosity at the coating/substrate interface of a thermal-sprayed coating to accommodate mismatches in thermal coefficient of expansion between the coating and the substrate.) These techniques require expensive equipment that is beyond the economic resources of many commercial thermal-spray coating facilities.

There are no techniques that are commonly used for filling, sealing, or densifying PVD coatings or pyrolytic and similar conversion coatings, with the exception of pyrolytic and conversion coatings used for decorative purposes. Chemical-conversion coatings used decoratively, such as patinas, are usually sealed with wax or shellac.

Electrophoresis is movement in a solution or a dispersion of charged molecules or particles under the action of an applied electric field. During electrophoretic coating deposition, charged particles in liquid suspension migrate toward, and deposit on, an oppositely charged conductive electrode which may be either the cathode or the anode, depending on particle charge; for the particular materials described as examples in the present invention, the coating substrate is cathodic. Electrophoretically deposited coatings have many practical advantages that have led to their commercial use. For example:

1. many different materials can be made electrophoretically active and deposited on conductive substrates,
2. coating thickness can be readily controlled,
3. thick coatings (order of millimeters) can often be applied,
4. two or more materials can often be co-deposited,
5. coating occurs rapidly, and
6. scale-up to production is straightforward.

Deposition rate decreases with time due to the increasing electrical resistance of the growing film during constant-voltage electrophoretic deposition. Since film deposition is enhanced in defective regions of the growing film where the electric field is the highest, pinhole-free films of uniform thickness can be deposited on surfaces of even complex shape.

U.S. Pat. No. 4,357,222 describes an electrophoretic casting process which produces highly dense green castings with residual liquid (water) below 7%.

U.S. Pat. No. 4,971,633 describes a thin, porous, $Al_2O_3$ film, used in solar cells, filled with an electrophoretically deposited layer of a styrene acrylate resin.

SUMMARY OF THE INVENTION

The present invention concerns electrophoretically active sol-gel processes to fill, seal, and/or density porous, flawed, and/or cracked coatings comprised of dielectrics, ceramics, or semiconductors to yield more thermally robust composite materials suitable for an expanded range of environments, such as reactive organic vapors, oxygen plasmas, and high vacuum, than the material described in U.S. Pat. No. 4,971,633.

Certain preparations commonly used for sol-gel processing are electrophoretically active. Electrophoretic activity can be induced in many sol-gel preparations by altering bath chemistry; for example, by manipulating pH which alters the surface charge of the depositing particle. When porous, cracked, or flawed coatings on electrically conductive substrates are immersed in these sol-gel baths and electrically biased relative to a counter electrode that contacts the bath, electrophoretically active micelles of ceramic precursor compounds deposit preferentially at locally high electric-field sites associated with pores, flaws, and cracks.

The properties of certain types of porous, flawed, or cracked coatings that are so treated may be significantly altered and improved thereby. For example, the addition of ceramic material to the interstices of a coating will generally improve the thermal conductivity increase mechanical strength, and affect optical and electrical properties. If the ceramic material is of a particular chemical species, then corrosion resistance of the body could be enhanced. The filling of interstices will reduce outgassing in vacuum environments. Overall surface area can be reduced.

The present invention demonstrates that even relatively large voids can readily be filled by electrophoretically active sol-gel processes to yield ceramics—with a tailored distribution of grain sizes, if desired - deposited in the voids to control pore size and density.

It is an object of this invention to use electrophoretically active sol-gel preparations to backfill, seal, or densify porous, cracked, and flawed dielectric, ceramic, or semiconductor coatings on electrically conductive substrates to alter one or more of the following: (1) corrosion resistance, (2) electrical properties, (3) thermal properties, (4) optical properties, (5) outgassing properties, and/or (6) surface area.

For example, the optical properties of porous coatings that are filled by electrophoretically active sol-gel processes can be optimized by selecting a process, of the many available, that yields ceramic material with an appropriate grain size and shape, optical absorption, refractive index, and dispersion. Tailored particle shape is a feature of many sol-gel derived materials and may be exploited to impart additional desired features to the filling coating. For example, spherical particles of varying sizes may be desirable to efficient filling of voids whereas filling with platelets may yield a dense layered structure within the void. Additional variations in optical properties can be obtained if the porous coatings are dyed, or loaded with optically active particles, and a sol-gel ceramic with complementary optical properties is used to seal the dye or particles in place.

It is a further object of this invention to fill cracks and defects in dielectric, ceramic, and semiconductor coatings with multiple deposits of electrophoretically active sol-gel preparations selected to yield ceramics of varying composition and/or graded grain sizes deposited in the voids to achieve novel and useful properties.

BRIEF DESCRIPTION OF THE DRAWINGS

FIG. 2 Successive electrophoretic, sol-gel ceramic fillings of a void in a coating on an electrically conductive substrate. As one example of many variations, grains of successively smaller size may be deposited as follows:

DETAILED DESCRIPTION OF THE INVENTION

Figure 1:
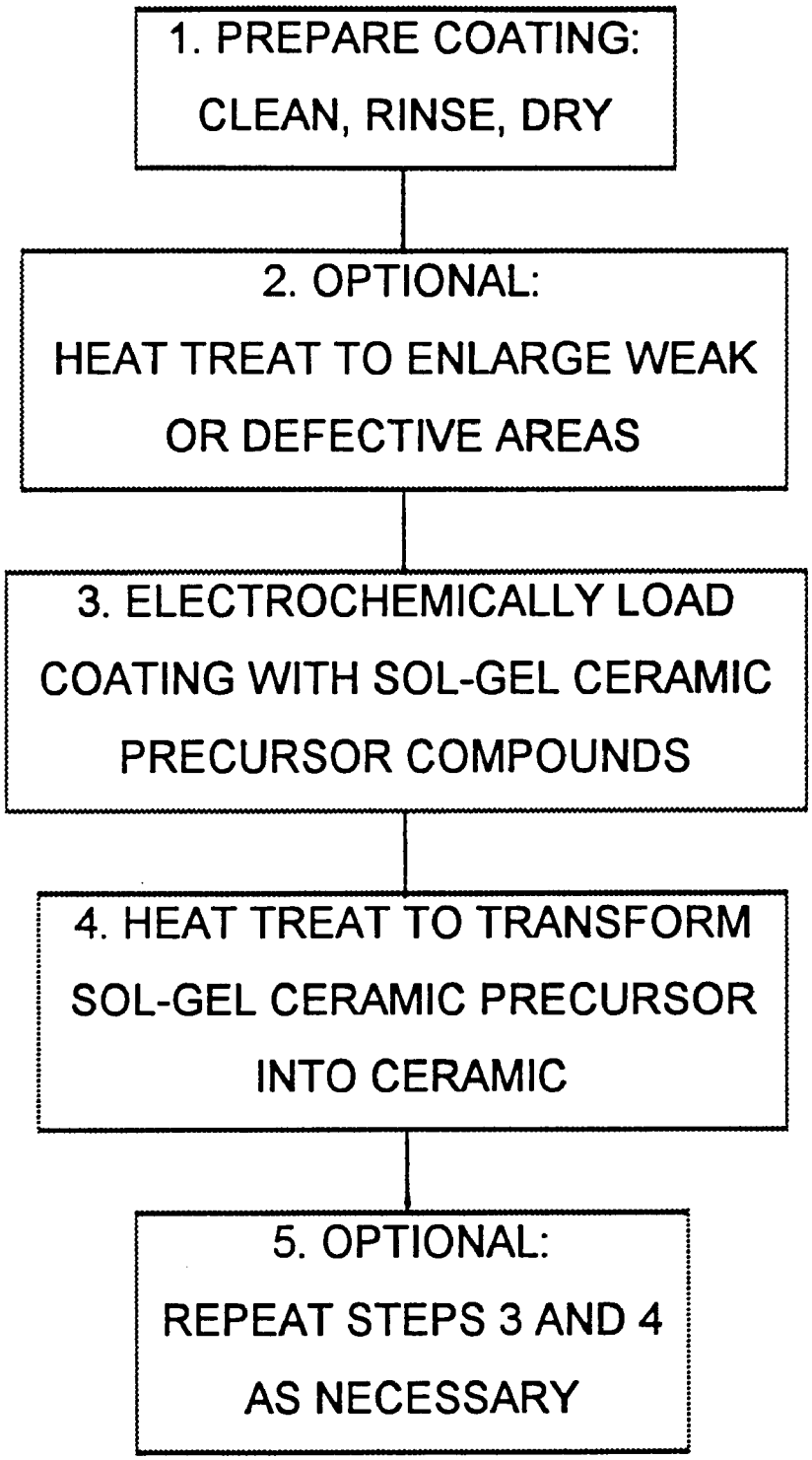
FIG. 1 Process flow chart for electrophoretic deposition of sol-gel ceramics.

FIG. 1 shows a typical process for the deposition of electrophoretically deposited sol-gel ceramics. Step 5 of FIG. 1 suggests the procedure whereby successive deposits may be made to achieve the effect shown in FIG. 2, for example. A preferred embodiment of the invention is as follows:

Anodic Coating

As an example, of the several types of coatings amenable to the electrophoretic treatment of the present invention, anodic coatings approximately 38 micron thick were formed on 51-mm diameter, 1-mm thick disks of 6061-T6 aluminum alloy. The disks, stamped from a single mill run of rolled sheet stock, were prepared for anodization using a sodium hydroxide preliminary etch, and a nitric acid desmutting final etch. A number of substrates were anodized in 14 wt % sulfuric acid at each of three processing temperatures to produce coatings with a range of porosities:

1. 17–20° C.; highest porosity,
2. 9–11° C.; intermediate porosity,
3. 0–6° C.; lowest porosity.

Cleaning

Anodized samples were cleaned before coating as follows:

1. degreased in trichloroethylene vapor at 80° C.,
2. washed in a detergent-alcohol solution (6 liters isopropanol, 1.5 liters deionized water, 1.5 ml Triton-X100™, 3.75 ml Span-80™) for 15 min,
3. rinsed in flowing deionized water,
4. rinsed in hot (approx. 75° C.) deionized water for 2 min, and
5. blown dry with nitrogen gas.

Pre-Heating

Some samples were heated in air at a rate of 10° C./min to 450° C. for 15 minutes before depositing sol-gel precursor compounds. This was done to rupture weak areas of the anodic films, opening channels in the film through which sols could more readily penetrate.

Solution Preparation $Al_2O_3$—$SiO_2$ $Al_2O_3$—$SiO_2$ sols are electrophoretically active. A typical $Al_2O_3$—$SiO_2$ sol precursor may be prepared by mixing equal volumes of absolute ethanol and tetraethylorthosilicate (TEOS), and subsequently adding a HCl-ethanol solution such that the final volume ratios of ethanol/TEOS/HCl are 6/5.9/1. Aluminum sec-butoxide (AsB) is added to the mixture; a ratio of 1 mole of TEOS to 1.1 moles of AsB. After vigorous mixing, the solution is diluted with 7.5 volumes of ethanol and heated, with stirring, at 80° C. for 16 h in a sealed flask equipped with a reflux condenser. Water is added to the solution to facilitate polymerization. Solutions with final molar ratios of water/TEOS ranging from 10–100 can be prepared to yield coatings with variations in structure, refractive index, wettability, and thickness. A water concentration of 25/1 is found to be most effective for electrophoretic deposition. Solution stability is also influenced by water concentration; sols with water/TEOS ratios lower than 50/1 are stable for several years when stored at −20° C.

Silica sols

Electrophoretically active silica sols, designated 7.5S and 20S, is prepared by acid catalyzed hydrolysis of TEOS, and have water/TEOS molar ratios of 7.5 and 20, respectively. These sols are prepared from a silica stock solution consisting of TEOS/ethanol/water/HCl mixed in the molar ratios 1/3.8/1/0.0075, and heated to 60° C. with stirring for 1.5 h in a sealed flask equipped with a reflux condenser. The stock solution is brought to room temperature and additional water is added to give a final water/TEOS molar ratio which may range from 2→20. Following addition of water, the solution is stirred for 30 min at room temperature and diluted with 2 volumes of ethanol. High-water sols (water/TEOS ratios of >15) may require warming to approximately 40° C. to promote complete incorporation of water. Both the silica stock solutions and the diluted sols are stable for several years when stored at −20° C.

Electrophoretic Deposition

Figure 2A:
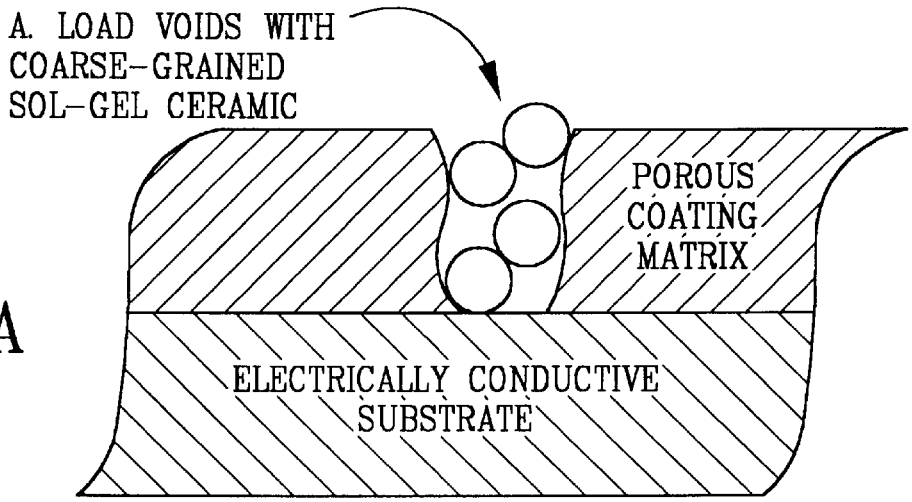
FIG. 2A First filling with coarse grains.
Figure 2B:
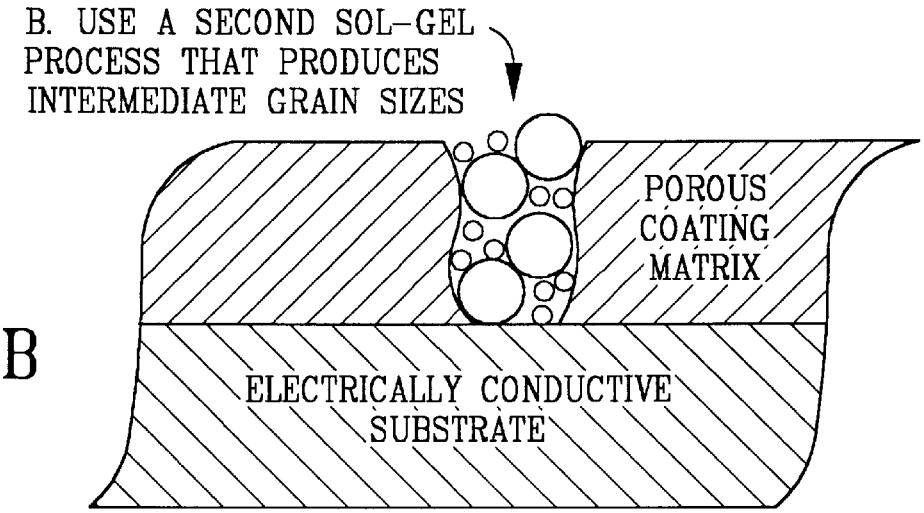
FIG. 2B Second filling with smaller grains to increase density.
Figure 2C:
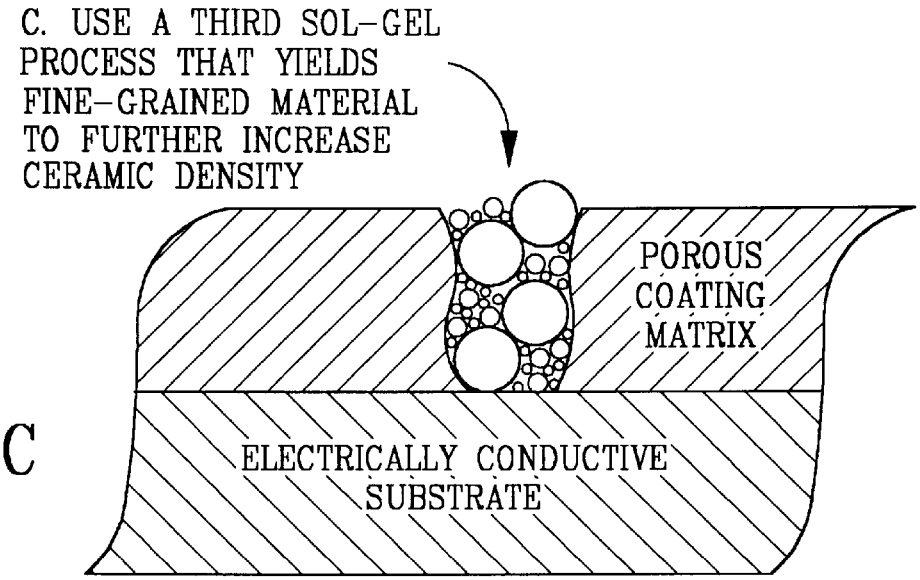
FIG. 2C Third filling with still smaller grains to further increase density.

Electrophoretic deposits were made in air by applying 5 V DC between a cathodically biased anodized substrate and a parallel counter electrode in a glass tank containing the coating sol. A range of deposition times of about 5–35 min was investigated. FIG. 2 shows how deposits of successively smaller grains into coating voids can maximize fill density.

Heat Treatment

After being electrophoretically treated, samples were removed from the sol-gel solution and heat treated in air at 2° C./min to 200° C., held at temperature for 2 h, and cooled at 50° C./min to room temperature, resulting in the conversion of the entrained ceramic precursor compounds to a ceramic.

Electrical Testing

Arrays of 6.35-mm diameter, 0.5-$\mu$m thick gold dots were thermally evaporated onto sample surfaces. The dielectric properties of the coatings were measured across test capacitor sandwiches with the gold dots and the aluminum substrates as the electrodes. Measurements were made by probing three to five gold dots per sample with a loop of 1.27-mm diameter copper wire. Capacitance, dissipation factor, and electrical leakage were measured with a capacitance bridge in air at room temperature and 18–25% relative humidity at 1,10, and 100 kHz. Breakdown strength B was assumed to be the voltage at which leakage current first exceeded 60 $\mu$A when voltage was ramped at 25 V/s.

Figure of Merit

The product of the 1-kHz sample capacitance C and the sample breakdown voltage $V_{bd}$ gives a useful figure of merit F for assessing coating properties. This parameter is not expected to depend on sample thickness, a value that is often difficult and time consuming to measure accurately. The capacitance of the test sample depends on the permittivity of free space $\epsilon_o$, dielectric constant $\kappa$, capacitor area A, and dielectric coating thickness t: $C=\kappa\epsilon_o A/t$. Breakdown voltage is given by $V_{bd}=Bt$. Therefore, $CV_{bd}=\kappa\epsilon_o A/B$, the figure of merit F which represents the largest electrical charge that can be stored by the capacitor.

Figure 3:
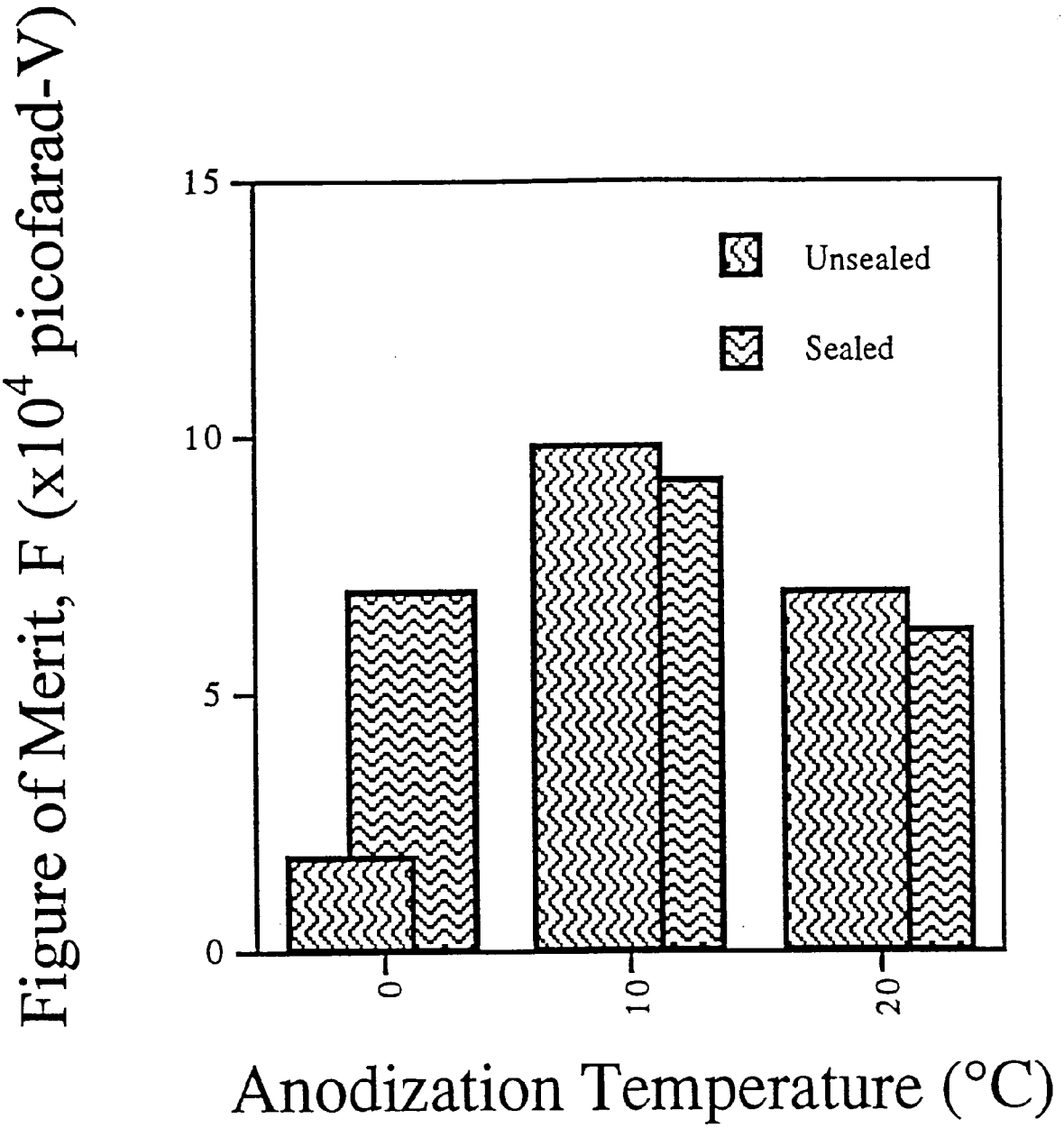
FIG. 3 Figure of merit for untreated anodic coatings and anodic coatings sealed with hot water.

FIG. 3 shows F for the experimental controls: untreated anodic coatings and anodic coatings sealed with hot water. The best dielectric properties are for samples anodized in electrolyte at 10° C.

Figure 4:
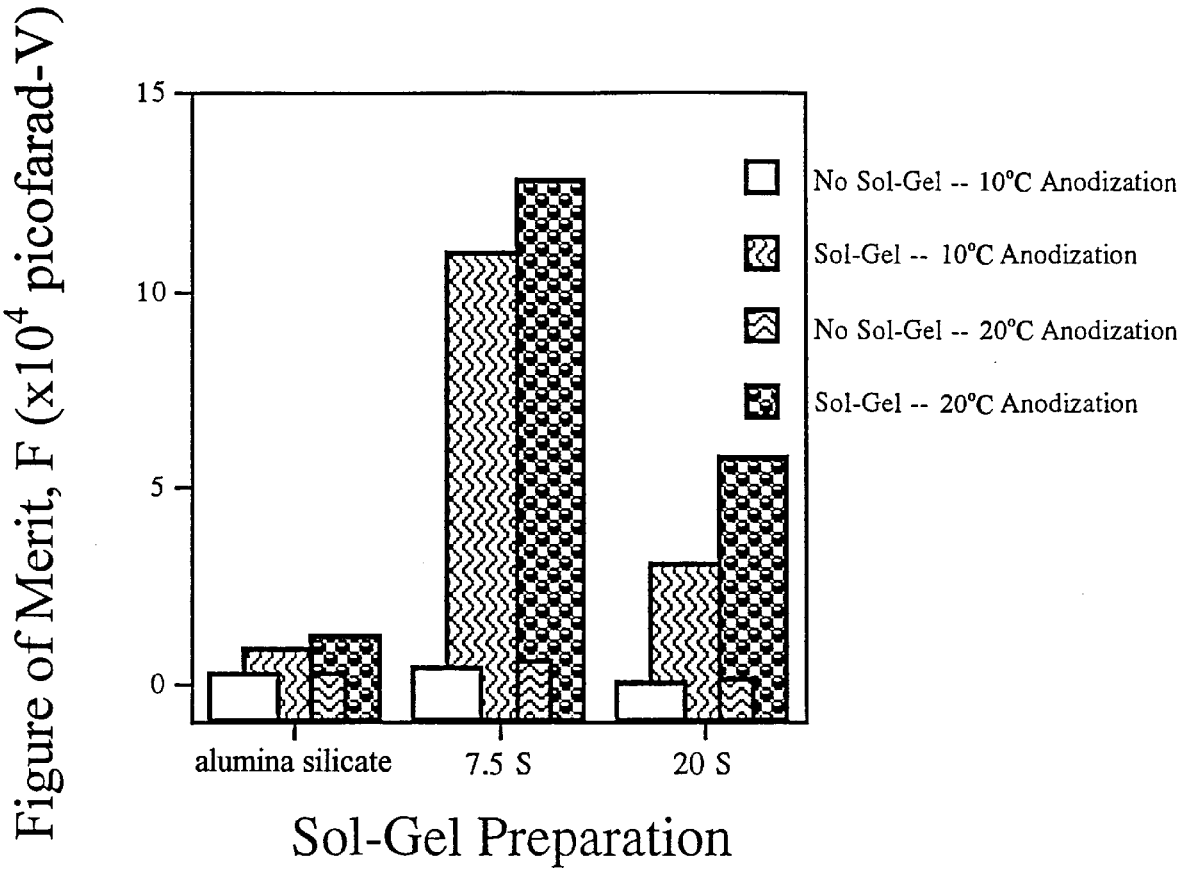
FIG. 4 Figure of merit for electrophoretically sol-gel treated and untreated samples. Anodized at 10 and 20° C. followed by 450° C. heat treatment to enlarge weak or defective areas before electrophoresis.

FIG. 4 compares F for anodized samples, heated at 450° C., which were electrophoretically sol-gel treated versus untreated. It is believed that the 450° C. heat treatment causes failure of weak areas in the anodic coating allowing the sol-gel to penetrate and thereby improve the coating. Sol-gel treated areas typically had better dielectric properties than untreated areas. The dielectric properties of a sample anodized at 10° C. and then coated with sol 7.5S were better than those of the best anodized coatings not treated electrophoretically.

What is claimed is:

1. A method to seal a porous coating on an electrically conductive substrate with sol-gel ceramic by electrophoretically active sol-gel processes, comprising:

cleaning the coating on the electrically conductive substrate;

electrophoretically depositing, preferentially at locally high electric-field sites associated with pores, cracks, and flaws, a prescribed amount of ceramic-precursor compounds from sol-gel ceramics onto and into the coating, comprising immersing the coating and its substrate, electrically biased, spaced adjacent an oppositely biased electrode, in an electrophoretically active sol-gel solution; and heating the coating and substrate to cause a chemical reaction to form a ceramic from the ceramic-precursor compounds to penetrate into and seal the coating, said ceramic being inseparably bound to the coating and the substrate.

2. The method of claim 1 further comprising pre-heating the coating after it is cleaned to rupture weak areas of the coating.

3. The method of claim 1 wherein the substrate is cathodically biased.

4. The method of claim 1 wherein the substrate is anodically biased.

5. The method of claim 1 wherein the coating is an anodic coating.

6. The method of claim 1 wherein the coating is a ceramic.

7. The method of claim 1 wherein the coating is a dielectric.

8. The method of claim 1 wherein the coating is a semiconductor.

9. The method of claim 1 wherein the coating is deposited by physical vapor deposition.

10. The method of claim 1 wherein the coating is deposited by chemical vapor deposition.

11. The method of claim 1 wherein the coating is deposited by a chemical-conversion process.

12. The method of claim 1 wherein the coating is deposited by plasma spraying.

13. The method of claim 1 wherein the coating is deposited by high-velocity oxy/fuel spraying.

14. The method of claim 1 wherein the coating is deposited by flame spraying.

15. The method of claim 1 wherein the coating is deposited by applying an electrostatically charged powder.

16. The method of claim 1 wherein the electrophoretically deposited compounds comprise two or more compositionally different species.

17. The method of claim 16 wherein the compositionally different species are co-deposited.

18. The method of claim 1 wherein the step of electrophoretically depositing a prescribed amount of ceramic-precursor compounds onto and into the coating is repeated.

19. The method of claim 1 wherein the electrophoretically deposited compounds comprise two or more differently sized species.

20. The method of claim 19 wherein the differently sized species are co-deposited.

21. The method of claim 19 wherein the differently sized species are compositionally different.

22. The method of claim 20 wherein the differently sized species are compositionally different.

23. The method of claim 1 wherein the sol-gel ceramics have a desired optical absorption.

24. The method of claim 1 wherein the sol-gel ceramics have a desired optical dispersion.

25. The method of claim 1 wherein the sol-gel ceramics have a desired refractive index.

26. The method of claim 1 wherein the sol-gel ceramics, with optical properties complementary to the coating, are formed onto and into the coating which has been preloaded with dye particles, to seal the dye particles in place.

27. The method of claim 1 wherein the sol-gel ceramics, with optical properties complementary to the coating, are formed onto and into the coating which has been preloaded with optically active particles, to seal the optically active particles in place.

* * * * *